US005509779A

United States Patent [19]

Mori et al.

[11] Patent Number: 5,509,779

[45] Date of Patent: Apr. 23, 1996

[54] SELF-PRIMING CHEMICAL PUMP

[75] Inventors: Yoji Mori, Saitama; Kenichi Satoh, Ibaraki, both of Japan

[73] Assignee: World Chemical Co., Ltd., Tokyo, Japan

[21] Appl. No.: 380,687

[22] Filed: Jan. 30, 1995

[30] Foreign Application Priority Data

Feb. 3, 1994 [JP] Japan ..... 6-011911

[51] Int. Cl.[6] ..... F04D 9/00

[52] U.S. Cl. ..... 415/56.1; 415/56.3; 415/56.6

[58] Field of Search ..... 415/56.1, 56.2, 415/56.3, 56.4, 56.5, 56.6; 417/420

[56] References Cited

U.S. PATENT DOCUMENTS

| | | | |
|---|---|---|---|
| 1,948,366 | 2/1934 | Barzen | 415/56.1 |
| 1,981,025 | 11/1934 | Bird | 415/56.1 |
| 2,291,760 | 8/1942 | Rupp | 415/56.6 |
| 2,627,817 | 2/1953 | Mann et al. | 415/56.6 |
| 4,637,778 | 1/1987 | Pollari | 415/56.3 |
| 5,154,587 | 10/1992 | Mori et al. | 417/420 |

FOREIGN PATENT DOCUMENTS 51-22322 9/1976 Japan .

*Primary Examiner*—John T. Kwon
*Attorney, Agent, or Firm*—Oliff & Berridge

[57] ABSTRACT

A self-priming chemical pump which comprises: a pump portion including at least an impeller and a shaft supporting the impeller; a self-priming mechanism portion including a self-priming chamber which is provided in the discharge side of a vortex chamber of the impeller so as to communicate with a discharge opening, and a suction chamber which is provided in the suction side of the vortex chamber of the impeller so as to communicate with a suction opening; a seal wall which is provided in the vicinity of the discharge side of the vortex chamber to form a slight gap along the outer circumference of the impeller; and a circulation hole which is provided in the self-priming chamber so as to be located inside the outer circumference of the impeller.

6 Claims, 9 Drawing Sheets

SELF-PRIMING CHEMICAL PUMP

BACKGROUND OF THE INVENTION

1. Field of the Invention

The present invention relates to a self-priming chemical pump.

2. Description of the Related Art

Heretofore, there are few cases where centrifugal volute type chemical pumps are made of metal but there are most cases where they are made of plastics, because they are adapted to medical fluids strong in chemical activity. This type of chemical pump disposed on a medical fluid tank becomes unable to pump a fluid when air is mixed in the fluid in a period in which the pump operates. In this occasion, the pump is unable to the liquid unless air escapes and plastics will be deformed by friction heat to cause serious accidents if the pump runs idle. A self-priming chemical pump can be used so that air escaping can be achieved by a self-priming remaining fluid. In this occasion, a check valve is operated so that the self-priming fluid remains in the inside of the self-priming chemical pump. In the next operation of the pump, air in the pump is discharged by the self-priming remaining fluid to form a negative pressure state in the pump to thereby suck the medical fluid in the suction piping to perform a steady-state operation. In the self-priming chemical pump of the type in which the self-priming remaining fluid is secured by operating the check valve, however, solid matter may be disposed on the seal surface of the check valve in the case of a crystalline fluid or a slurry fluid so that the check valve cannot be closed. As a result, the fluid in the pump may be made to escape from the inside of the pump so that no self-priming fluid remains in the pump. In this occasion, the pump runs idle when the next running of the pump is started. This may cause serious accidents.

From this point of view, the Applicant of the present application has developed a valveless self-priming pump (see Japanese Utility Model Postexamination Publication No. 2322/1976). This self-priming pump comprises a self-priming chamber communicating with the discharge side of an impeller, and a suction chamber communicating with the suction side of the impeller. The suction chamber is separated, by a separation wall having communication pores at its upper and lower portions, into a portion directly communicating with a suction opening and a portion not directly communicating with the suction opening. When the operation of the pump is stopped, the fluid is siphon-cut so as to remain both in the self-priming chamber and in the suction chamber. The fluid reserved in the portion not directly communicating with the suction opening returns slowly to the portion directly communicating with the suction opening through the above-mentioned pores at the lower portion of the self-priming chamber, so that a large quantity of the self-priming remaining fluid can be reserved.

In the above self-priming pump proposed by the Applicant of the present application, not only siphon-cutting is performed easily but also the volume of the suction chamber is large though the pump is of a valveless type, so that a large quantity of the self-priming fluid can remain. Accordingly, the above pump is excellent in the point of view that self-priming characteristic can be fulfilled sufficiently. In the above pump, however, a circulation hole a provided between the self-priming chamber and the vortex chamber is located outside the outer circumference of the impeller b as shown in FIG. 15. Accordingly, because the fluid blown out from the circulation hole a serves to push back the fluid which remains in the vortex chamber c and which is urged to move outward by the impeller b, these fluids are mixed with each other in the vortex chamber c. Accordingly, air moves slowly, so that the magnitude of negative pressure at the center portion of the impeller p cannot be made large rapidly. Accordingly, the self-priming speed is made slow. Further, because the gap between the vortex c and the impeller b is sufficiently large, the fluid and air contained in the fluid are made to rotate in the vortex chamber c. Accordingly, the air does not go out to the discharge side of the vortex c rapidly, so that the centrifugal action by the impeller b is weakened. Accordingly, the magnitude of the negative pressure at the center portion of the impeller b cannot be made large rapidly. Accordingly, the self-priming speed is made slow. Particularly in the case of a high-temperature fluid or a fluid containing bubbles, the influence thereof is remarkable so that there is a risk of shortage of self-priming characteristic.

Further, because the portion directly communicating with the suction opening is L-shaped, siphon-cutting is made later so that a larger quantity of self-priming fluid than required is taken in the suction piping.

SUMMARY OF THE INVENTION

Therefore, the present invention is designed upon such circumstances, and it is an object of the present invention to provide a self-priming chemical pump in which not only siphon-cutting is made rapid but also self-priming speed is made high so that the pump can be adapted to a high-temperature fluid or a fluid containing bubbles.

To solve the aforementioned problems, according to an aspect of the present invention, the self-priming chemical pump comprises: a pump portion including at least an impeller and a shaft supporting the impeller; a self-priming mechanism portion including a self-priming chamber which is provided in the discharge side of a vortex chamber of the impeller so as to communicate with a discharge opening, and a suction chamber which is provided in the suction side of the vortex chamber of the impeller so as to communicate with a suction opening; a seal wall which is provided in the vicinity of the discharge side of the vortex chamber to form a slight gap along the outer circumference of the impeller; and a circulation hole which is provided in the self-priming chamber so as to be located inside the outer circumference of the impeller.

Preferably, the above self-priming chemical pump further comprises an air separation plate which is provided in the self-priming chamber.

Preferably, in the above self-priming chemical pump, the suction chamber is constituted by an L-shaped suction passage for making the suction opening communicate with the suction side of the vortex chamber, and a self-priming liquid remaining portion having pores communicating with the suction passage; and there is provided a siphon-cut shortest passage in the suction passage.

Preferably, in above the self-priming chemical pump, the volume of the self-priming chamber is substantially equal to the volume of the suction chamber.

Preferably, in the above self-priming chemical pump, the pump portion is constituted by a magnet pump which includes: a casing surrounded by a rear casing and an outer wall of the self-priming chamber; the impeller rotatably mounted on a shaft put in the casing and fixed to the casing through fixed shaft bearings; a rotary shaft bearing having heat conduction blocking grooves and being provided between the shaft and the impeller; a heat insulating member fixed on the whole circumference of the rotary shaft bearing and provided between the shaft and the impeller; and thrust bearings provided on the shaft located at axially opposite sides of the rotary shaft bearing so that the thrust bearings are disposed at a predetermined distance from the rotary shaft bearing at the time of idle operation or the like of the impeller.

Preferably, the above self-priming chemical pump further comprises a front side fixed shaft bearing which is provided separately and fitted into the outer wall of the self-priming chamber of the casing; and wherein the front side fixed shaft bearing has a liquid conducting passage and a heat radiation hole which are formed between the casing and the shaft.

Preferably, in the above self-priming chemical pump, cushioning members are provided respectively between the two thrust bearings and front side and rear side fixed shaft bearings which are disposed at opposite ends of the shaft respectively.

Preferably, in the above self-priming chemical pump, heat conduction blocking grooves are provided in the heat insulating member, the cushioning members and the front side and rear side fixed shaft bearings, respectively.

In the self-priming chemical pump configured as described above, when the impeller is rotated, liquid remaining in the suction chamber is discharged to the discharge side of the vortex chamber by the centrifugal force of the impeller and at the same time liquid remaining in the self-priming chamber is directly injected into the impeller from the circulation hole located in the inside of the outer circumference of the impeller so that the liquid remaining in the self-priming chamber as well as the liquid remaining in the suction chamber are discharged rapidly to the discharge side of the vortex chamber by the centrifugal force of the impeller so as to be moved to the self-priming chamber. Accordingly, the negative pressure at the center portion of the impeller becomes high, so that liquid in the suction piping is moved up whereas air is mixed with the liquid given from the suction chamber and the circulation hole and is discharged to the self-priming chamber from the vortex chamber. The air sucked together with the liquid from the suction chamber in this occasion is prevented from circulating in the vortex chamber by the seal wall of the vortex chamber. Accordingly, the air is moved with the liquid to the self-priming chamber. Then, the air light in specific gravity is discharged from the discharge opening whereas the liquid is reserved in the self-priming chamber so that the liquid is directly injected into the impeller from the circulation hole again so as to circulate. After the air is discharged thoroughly from the suction piping, the suction chamber, the vortex chamber and the self-priming chamber, a steady-state operation is carried out. On the other hand, when the impeller is stopped, liquid in the suction piping falls down so as to flow backward. As a result, the pressure in the suction chamber becomes negative, so that the liquid surface in the discharge side passage of the vortex chamber is moved down so as to be lower than the level of the suction side passage of the vortex chamber. In this occasion, air is made to escape from the suction opening via the suction chamber so as to be siphon-cut. Accordingly, liquid is not made to escape any more.

Further, when liquid containing air is discharged from the vortex chamber to the self-priming chamber by the impeller so as to circulate, the liquid collides with the air separation plate. As a result, air light in specific gravity is moved up so as to escape from the discharge opening.

Further, when the impeller is stopped and the liquid in the suction piping falls down so as to flow backward so that the liquid surface is moved down so as to be lower than the level of the suction side passage of the vortex chamber, air escapes from the suction opening linearly through the siphon-cut shortest passage.

Further, when the volume of the self-priming chamber is equal to the volume of the suction chamber, the whole quantity of liquid in the suction chamber is moved to the self-priming chamber by the rotation of the impeller. Accordingly, the liquid surface in the suction piping is moved up by the quantity of liquid, so that liquid twice as much as liquid before the movement circulates in the self-priming chamber and the vortex chamber. Accordingly, the quantity of sucked liquid is large, so that the self-priming operation is completed speedily.

Further, when the pump portion is constituted by a magnet pump, liquid leaking is avoided because there is no shaft seal portion. Further, even in the case where the impeller operates under unstable pressure caused by cavitation or maloperation (hereinafter referred to as "idle running"), the rotary shaft bearing does not slide against the thrust bearings because there is no thrust created in the impeller. That is, in this case, friction heat is created only between the impeller and the rotary shaft bearing. The heat conduction blocking grooves formed in the rotary shaft bearing constitute a double structure like the structure of a vacuum bottle, so that the conduction of the friction heat is almost prevented by an air layer of low heat conductivity in the heat conduction blocking grooves. Further, because the rotary shaft bearing rotates, air is stirred by the heat conduction blocking grooves. As a result, air moves, so that friction heat scatters. Accordingly, heat is prevented from conducting to the impeller or the like. In addition, heat is prevented from conducting by the heat insulating characteristic of the heat insulating member per se.

Further, not only friction heat between the rotary shaft bearing and the shaft scatters from the heat radiation hole of the front side fixed shaft bearing and the liquid conducting liquid passage thereof but also the friction heat scatters from other surfaces of the front side shaft bearing because the distance from the friction heat creating portion to the casing is large. Accordingly, the heat is prevented from conducting to the casing or the like.

Further, though the rotary shaft bearing collides with the thrust bearings at the time of the shifting of the operation from ordinary running to idle running or at the time of the shifting of the operation from idle running to normally running, the shock created by the collision is absorbed by the cushioning members.

Further, when the heat conduction blocking grooves are provided in the heat insulating member, cushioning members and front side and rear side fixed shaft bearings, not only the conduction of the friction heat is prevented on the basis of the principle of a vacuum bottle but also air is moved by the air stirring function to make the friction heat scatter.

DESCRIPTION OF THE PREFERRED EMBODIMENT

An embodiment of the present invention will be described below in detail with reference to FIGS. 1 through 14.

Figure 1:
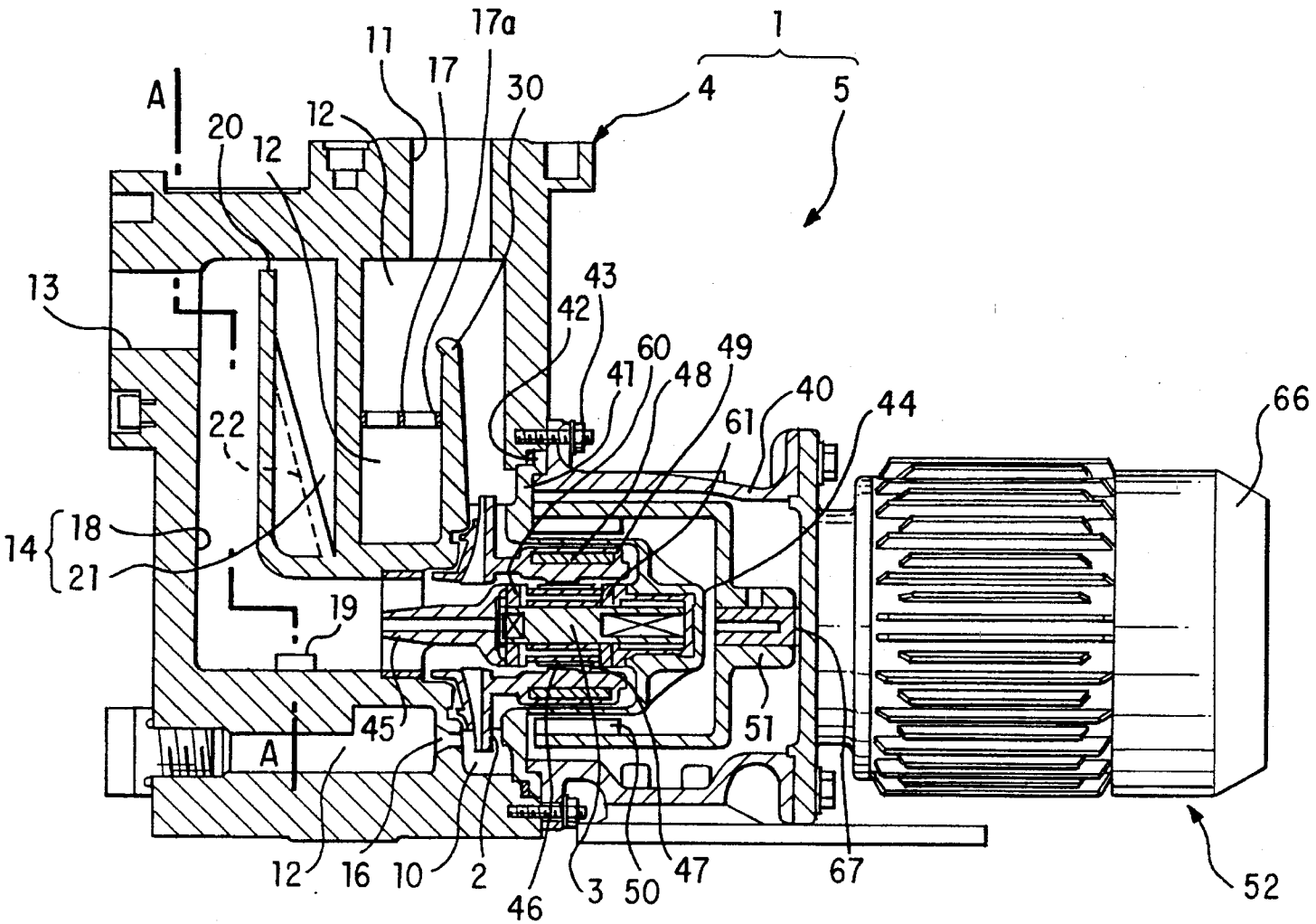
FIG. 1 is a longitudinal section showing a self-priming chemical pump according to the present invention.
Figure 3:
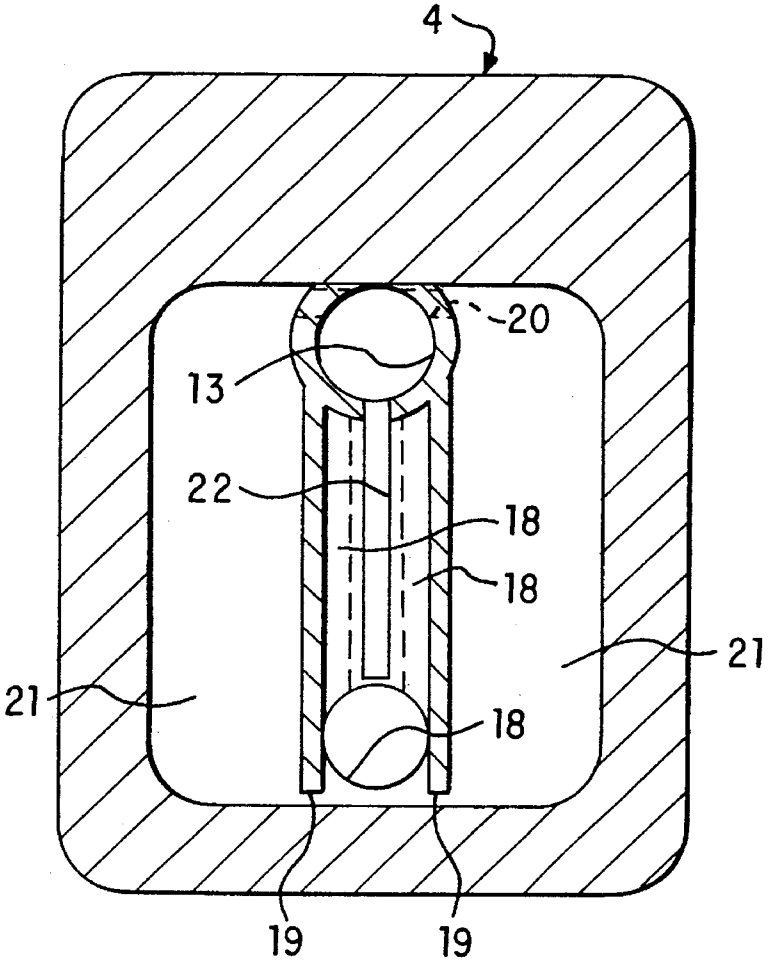
FIG. 3 is a section taken along the line A—A in FIG. 1.
Figure 2:
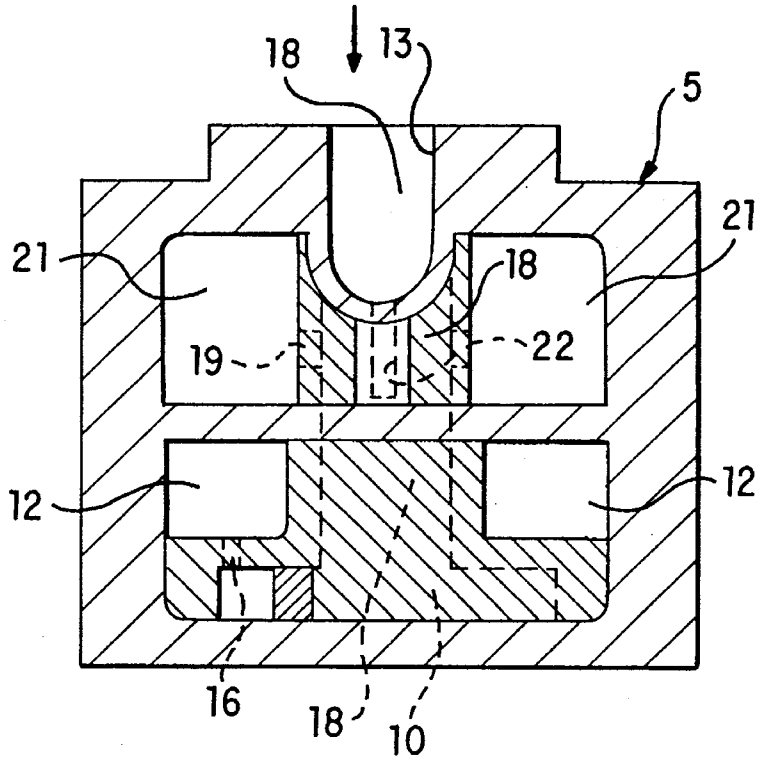
FIG. 2 is a cross section showing a self-priming mechanism portion which is one of elements constituting the present invention.
Figure 5:
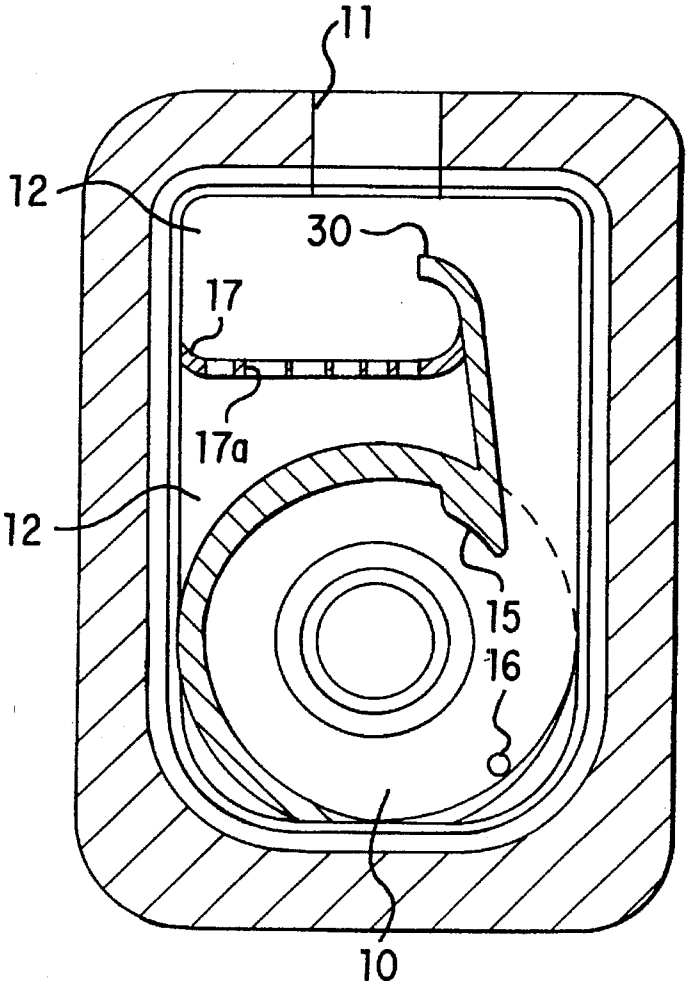
FIG. 5 is a section seen from the back of FIG. 4.
Figure 4:
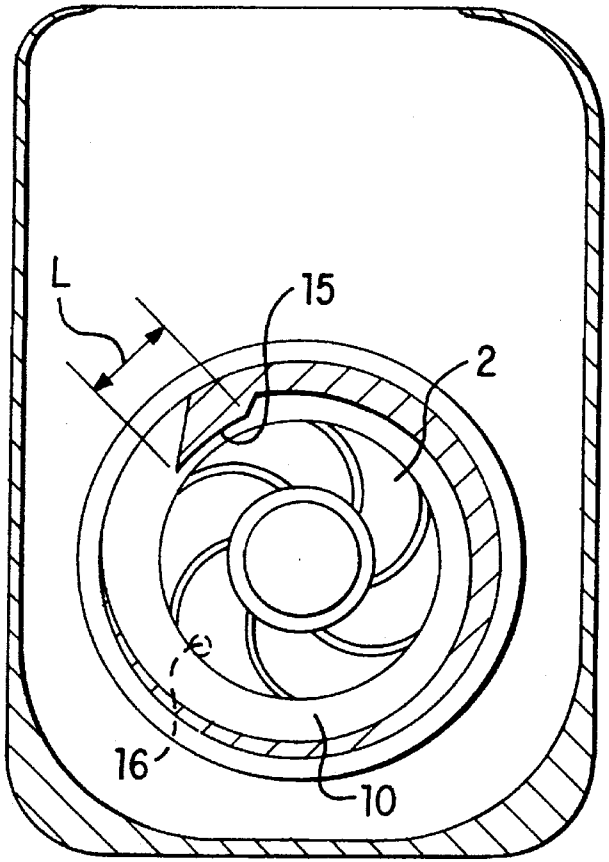
FIG. 4 is a section showing the relation between a vortex chamber and an impeller.
Figure 6:
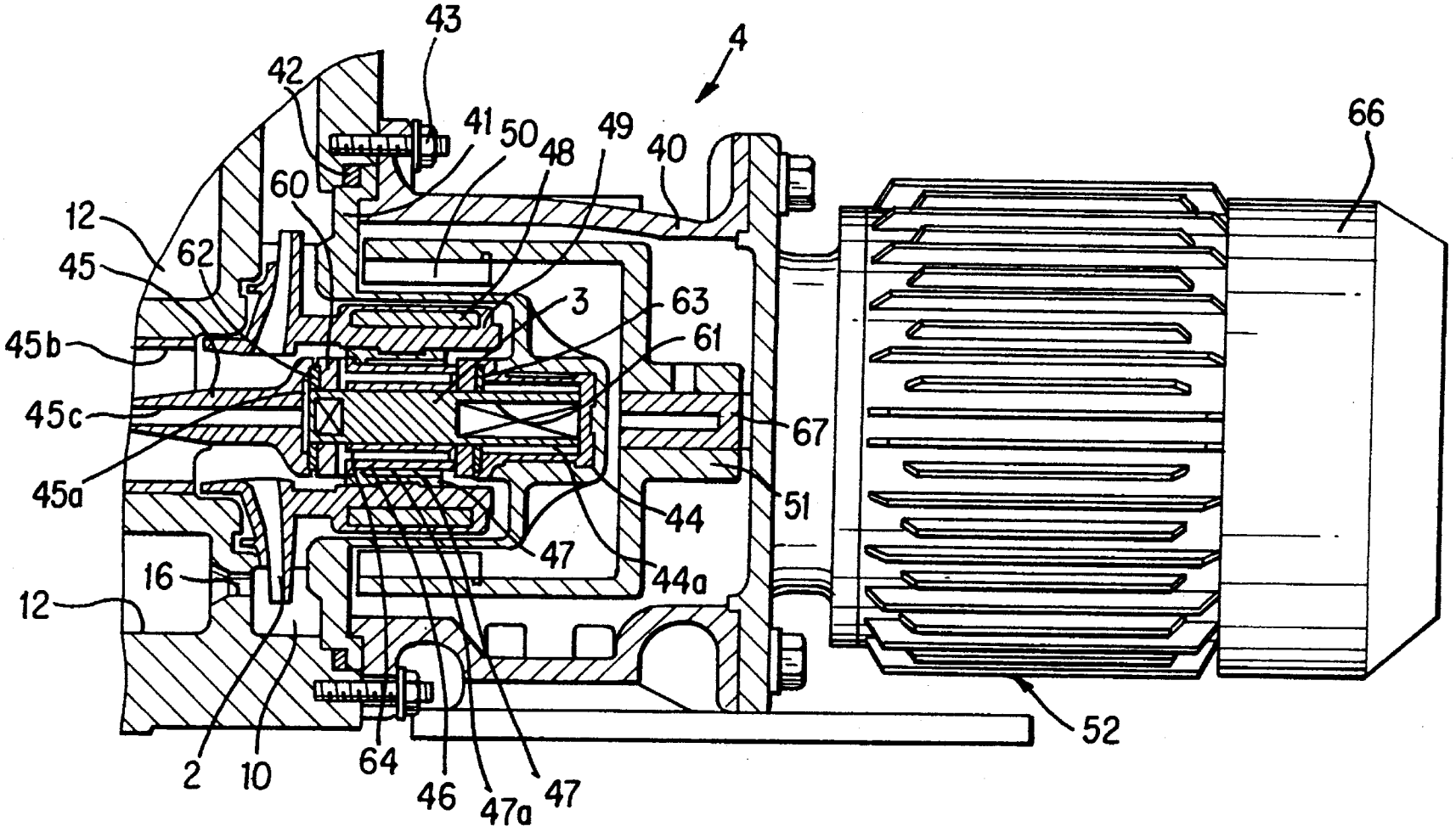
FIG. 6 is a longitudinal section showing a pump portion which is one of elements constituting the present invention.
Figure 8:
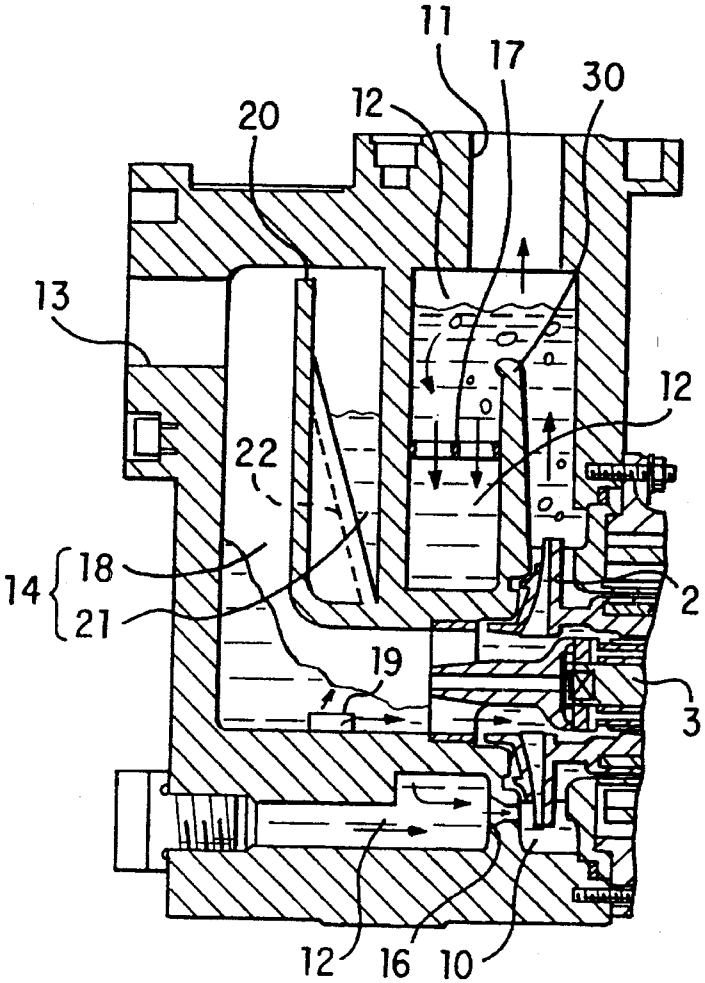
FIG. 8 is a longitudinal section showing the operation of the self-priming chemical pump according to the present invention.

FIG. 1 is a longitudinal section showing a self-priming chemical pump according to the present invention. FIG. 2 is a transverse section showing a self-priming mechanism portion which is one of elements constituting the present invention. FIG. 3 is a section taken along the line A—A in FIG. 1. FIG. 4 is a section showing the relation between a vortex chamber and an impeller. FIG. 5 is a section seen from the back side of FIG. 4. FIG. 6 is a longitudinal section showing a pump portion which is one of elements constituting the present invention.

In the drawings, the reference numeral 1 generally designates a self-priming chemical pump according to the present invention. The self-priming chemical pump 1 comprises a pump portion 4 and a self-priming mechanism portion 5. The pump portion 4 includes an impeller 2 and a shaft 3 which supports the impeller 2 so that the impeller 2 is rotatable. The self-priming mechanism portion 5 is airtightly connected to the pump portion 4.

The self-priming mechanism portion 5 includes a self-priming chamber 12 provided in the discharge side of a vortex chamber 10 of the impeller 2 so as to communicate with a discharge opening 11, and a suction chamber 14 provided in the suction side of the vortex chamber 10 so as to communicate with a suction opening 13. A seal wall 15 (see FIG. 4) is provided in the vicinity of the discharge side of the vortex chamber 10, that is, in the outer wall of the self-priming chamber 12 so that a slight gap is formed along the outer circumference of the impeller 2. Further, a circulation hole 16 is provided in the self-priming chamber 12 so as to be located inside the outer circumference of the impeller 2 within the vortex chamber 10. Further, an air separation plate 17 is provided in the self-priming chamber 12. The suction chamber 14 has an L-shaped suction passage 18 communicated with the suction opening 13 and also with the suction side of the vortex chamber 10, and a self-priming liquid remaining portion 21 having a communication hole (small hole) 19 communicated with the lower portion of the suction passage 18 and an air vent hole (small hole) 20 communicated with the upper portion of the suction passage 18. A siphon-cut shortest passage (hereinafter merely called "shortest passage") 22 is provided in the suction passage 18 so as to be linearly communicated with the suction opening 13 and with the suction side of the vortex chamber 10.

The vortex chamber 10 is disposed in a casing surrounded by a rear casing 41 of the pump portion 4 (which will be described later) and the outer wall of the self-priming chamber 12. The smaller the distance between the seal wall 15 of the vortex chamber 10 and the impeller 2, the higher the pressure therebetween. As a result, air contained in the liquid is prevented from circulating in the vortex chamber 10, so that the air moves with the liquid to the self-priming chamber 12 conveniently. If the distance between the seal wall 15 and the impeller 2 is too small in the case where the liquid is slurry or the like, the small distance however may cause clogging. Accordingly, the problem in this case is solved by increasing the length L of the seal wall 15. Further, the upper portion of the vortex chamber 10 forms a curved wall 30. A large number of pores 17*a* are provided in the air separation plate 17. When the self-priming liquid circulates in the self-priming chamber 12 and the vortex chamber 10, the curved wall 30 gives rotation force to the liquid to thereby give centrifugal force to the liquid in the self-priming chamber 12 so that the liquid collides with the air separation plate 17. As a result, air light in specific gravity is discharged to the discharge opening 11 rapidly on one hand and the self-priming liquid is injected from the lower circulation hole 16 into the impeller 2 through the pores 17*a* on the other hand.

The suction chamber 14 is shaped so that the suction passage 18 shaped like a 90° curved pipe for connecting the suction opening 13 and the suction side of the vortex chamber 10 is inserted into the self-priming liquid remaining portion 21. The suction chamber 14 is designed so that the volume of the self-priming liquid remaining portion 21 is maximized. Further, the shortest passage 22 is constituted by a groove provided in the suction passage 18 shaped like a 90° curved pipe. Accordingly, the shortest passage 22 connects the suction opening 13 and the suction side of the vortex chamber 10 at the shortest distance. When the surface of the liquid in the discharge side passage of the vortex chamber 10 becomes lower than the level of the suction side passage of the vortex chamber 10, air which comes into the suction chamber 14 through the discharge opening 11 which is light in specific gravity passes through the shortest passage 22 as a groove from the suction side of the vortex chamber 10 to the suction opening 13 so as to be siphon-cut.

The pump portion 4 is constituted by a magnet pump having no shaft seal portion. As described above, the pump portion 4 is airtightly connected to the self-priming mechanism portion 5. The connection is achieved by tightening a set of bolt and nut 43 while sandwiching a rear casing 41 and a seal material 42 between a housing 40 of the pump portion 4 and the outer wall of the self-priming mechanism portion 5. As main constituent elements, the pump portion 4 comprises; the housing 40; a casing disposed within the housing 40; the shaft 3 fixed to a rear side fixed shaft bearing 44 provided in the rear portion (rear casing) 41 of the casing and fixed to a front side fixed shaft bearing 45 provided in the outer wall surface of the self-priming chamber 12; the impeller 2 rotatably mounted on the shaft 3 through a rotary shaft bearing 46 and a heat insulating member 47 fitted onto the outer circumference of the rotary shaft bearing 46; and a driving portion 52 constituted by a magnet can 49 containing a driven magnet 48 and being fixed to the impeller 2, and a rotor 51 containing a drive magnet 50 disposed in the outside of the rear casing 41 so as to cooperate with the driven magnet 48 of the magnet can 49 to rotate the impeller 2.

Heat conduction blocking grooves 44*a* and 45*a* are formed in the rear side and front side fixed shaft bearings 44 and 45, respectively. As will be described later in detail, the heat conduction blocking grooves 44*a* and 45*a* are designed to block conduction of respective friction heat created by the friction between the shaft 3 and the rotary shaft bearing 46 and the friction between the rotary shaft bearing 46 and a front thrust bearing 60 (which will be described later) to thereby prevent the friction heat from conducting to the rear casing 41 and the outer wall surface of the self-priming chamber 12. Further, because a liquid conducting passage 45*b* and a heat radiation hole 45*c* are provided in the front side fixed shaft bearing 45, the distance from the shaft 3 to the outer wall surface of the self-priming chamber 12 is long and the surface areas of the passage and hole 45*b* and 45*c* become large so that the friction heat can scatter easily.

Opposite end portions of the shaft 3 are fixed to the rear side and front side fixed shaft bearings 44 and 45, respectively, so that the center of rotation is given to the impeller 2 and to the magnet can 49 containing the driven magnet 48.

The impeller 2 and the magnet can 49 are rotatably mounted on the shaft 3 through the rotary shaft bearing 46 and the heat insulating member 47. Further, front and rear thrust bearings 60 and 61 for supporting respective thrust loads of the impeller 2 and the magnet can 49 are fixed to the axially opposite sides of the rotary shaft bearing 46. The front and rear thrust bearings 60 and 61 are made from ceramics and designed so that the loads in the thrust directions of the front and rear thrust bearings 60 and 61 are received by the front side and rear side fixed shaft bearings 45 and 44 through cushioning members 62 and 63, respectively. The cushioning members 62 and 63 are made of shock absorbing materials such as rubber, etc. and provided with heat conduction blocking grooves, respectively.

The rotary shaft bearing 46 is shaped like a flanged cylinder and slidably mounted to the shaft 3 so as to be rotatable together with the impeller 2 and the magnet can 49. Heat conduction blocking grooves 64 are formed in the cylinder portion of the rotary shaft bearing 46 so as to be substantially concentric in the direction of the shaft. The heat insulating member 47 fitted onto the outer circumference of the rotary shaft bearing 46 has heat conduction blocking grooves 47*a* which are formed so as to be substantially concentric in the direction of the shaft in the same manner as in the rotary shaft bearing 46. The rotary shaft bearing 46 and the heat insulating member 47 form a double structure such as the structure of a vacuum bottle by the heat conduction bearing grooves 64 and 47*a*, so that air layers of low heat conductivity in the heat conduction blocking grooves 64 and 47*a* as well as the heat insulating characteristic of the heat insulating member 47 per se block the conduction of the aforementioned friction heat created by friction so that the friction heat cannot conduct to the outer wall of the self-priming chamber 12, the rear casing 41, the impeller 2 and the magnet can 49. Further, air is moved by rotation of the heat conduction blocking grooves 64 and 47*a* so that friction heat reached to the surfaces of the heat conduction blocking grooves 64 and 47*a* is made to scatter.

Further, because the heat insulating member 47 and the rotary shaft bearing 46 are provided separately, a material of high heat insulating characteristic can be selected freely as the material for the heat insulating member 47 without any limitation given by material quality required for the shaft bearing.

The driving portion 52 is provided to rotate the impeller 2. The rotor 51 of the driving portion 52 is connected to a shaft 67 of a motor 66 supported by a motor bracket 65. Accordingly, when the shaft 67 of the motor 66 rotates, the drive magnet 50 contained in the rotor 51 of the driving portion 52 rotates. Because the driven magnet 48 is driven to rotate by the drive magnet 50, the magnet can 49 rotates and accordingly the impeller 2 rotates.

The operation of the self-priming chemical pump 1 configured as described above will be described below.

Figure 7:
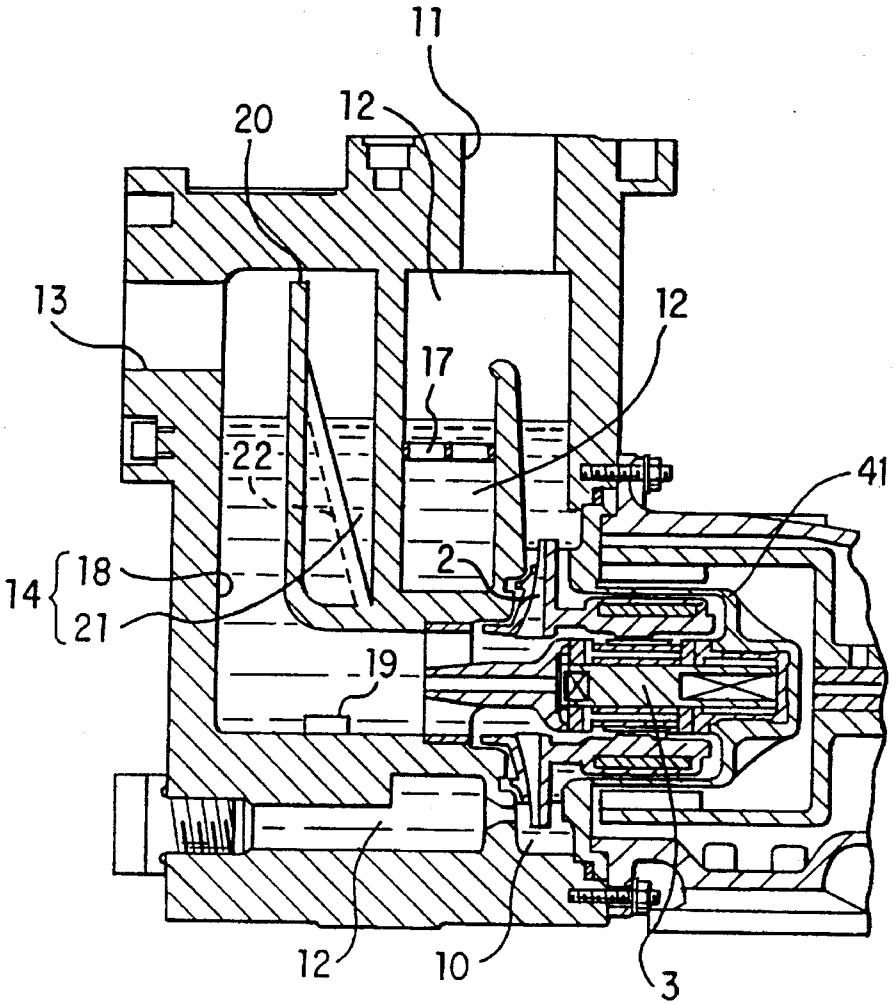
FIG. 7 is a longitudinal section showing the operation of the self-priming chemical pump according to the present invention.
Figure 10:
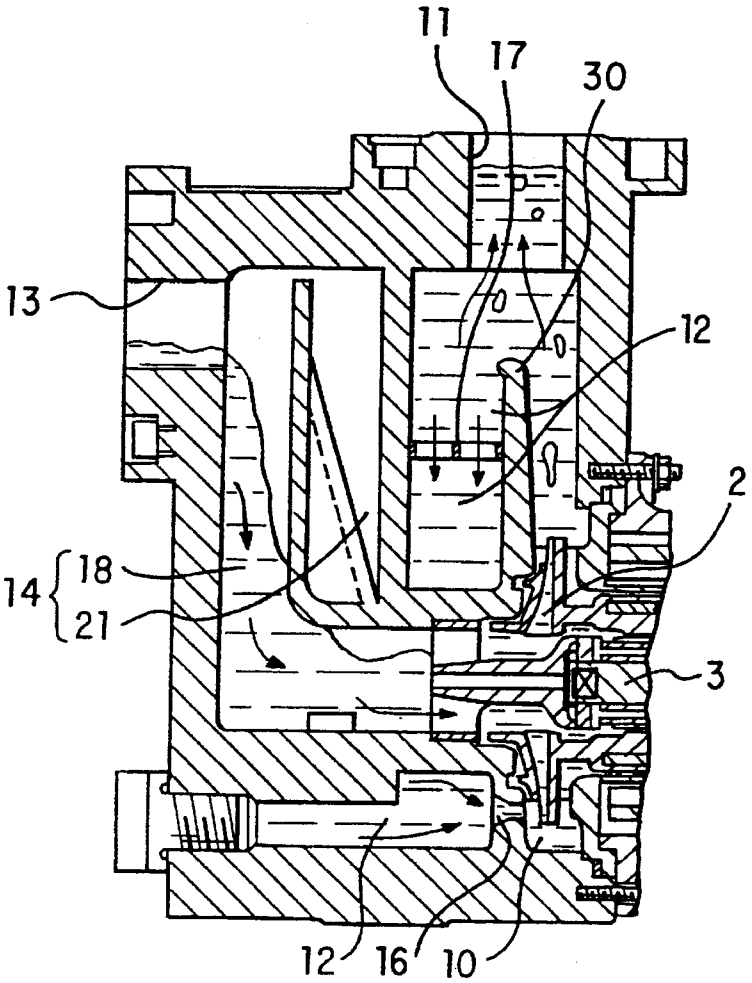
FIG. 10 is a longitudinal section showing the operation of the self-priming chemical pump according to the present invention.
Figure 9:
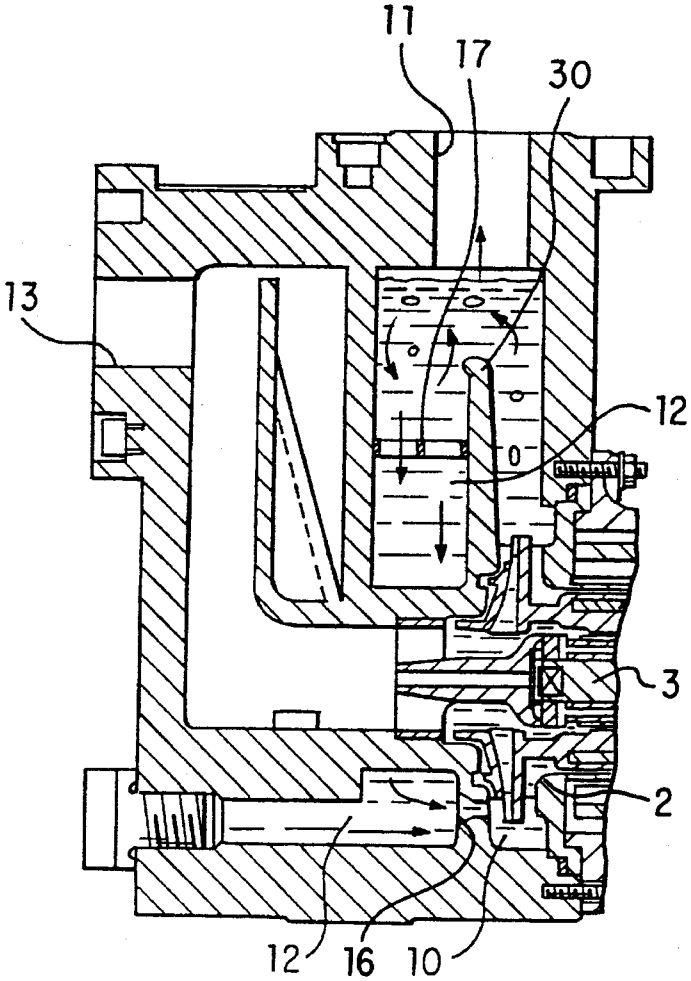
FIG. 9 is a longitudinal section showing the operation of the self-priming chemical pump according to the present invention.
Figure 12:
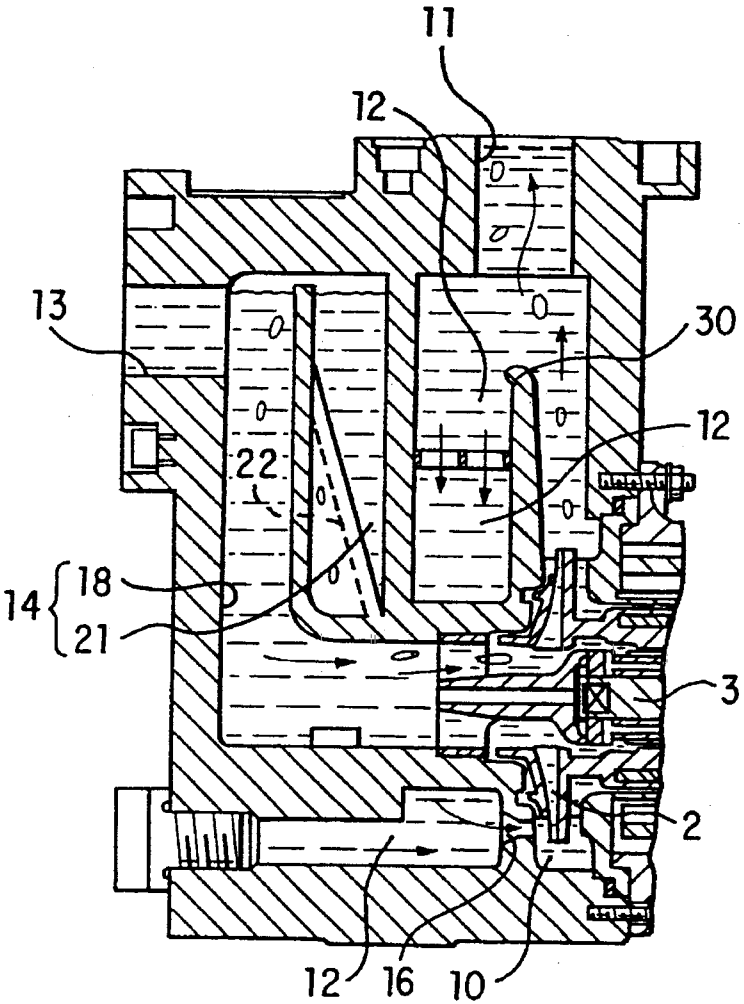
FIG. 12 is a longitudinal section showing the operation of the self-priming chemical pump according to the present invention.
Figure 11:
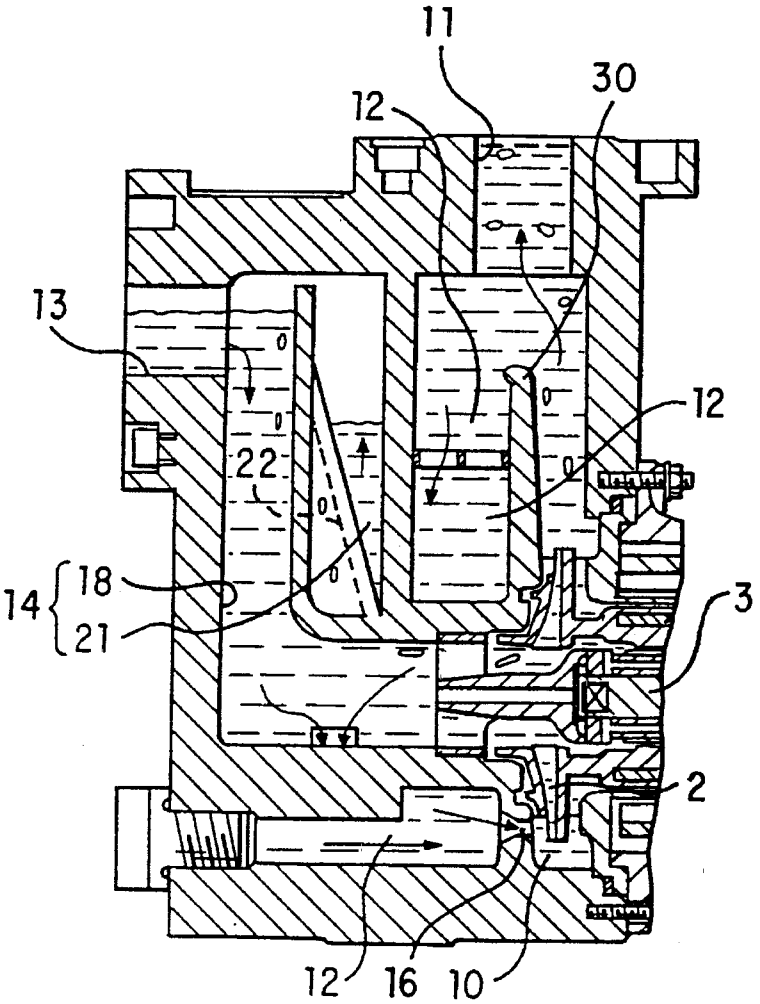
FIG. 11 is a longitudinal section showing the operation of the self-priming chemical pump according to the present invention.
Figure 14:
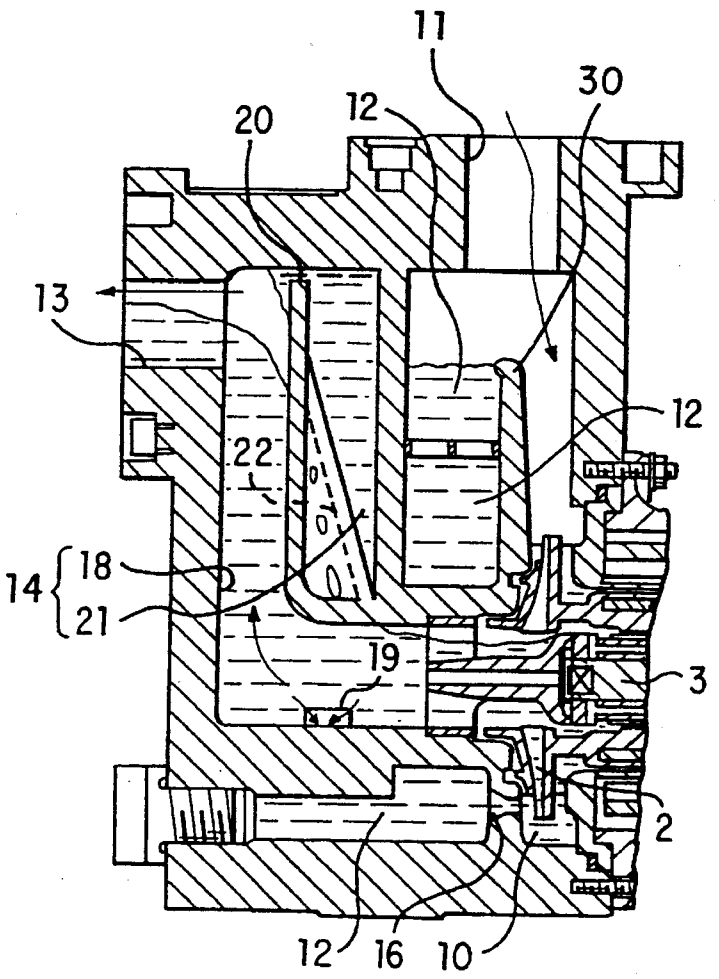
FIG. 14 is a longitudinal section showing the operation of the self-priming chemical pump according to the present invention.

The self-priming chemical pump 1 at a standstill is in a state shown in FIG. 7, that is, in a state in which self-priming liquid is reserved in the suction chamber 14, the self-priming chamber 12 and the casing (vortex chamber 10) sufficiently. In this state of the self-priming chemical pump 1, the driven magnet 48 is attracted by the drive magnet 50 so as to be fixed while gaps are formed between the rotary shaft bearing 46 and the front and rear thrust bearings 60 and 61 as shown in FIG. 6. When the motor 66 of the driving portion 52 is switched on, the drive magnet 50 rotates with the rotor 51, so that the driven magnet 48 in the magnet can 49 is driven to rotate by the drive magnet 50. As a result, the impeller 2 rotates, so that liquid in the suction passage 18 of the suction chamber 14 and in the vortex chamber 10 is discharged to the discharge side. Because the impeller 2 and the magnet can 49 in this occasion rotate around the shaft 3 through the heat insulating member 47 and the rotary shaft bearing 46, the impeller 2 receives thrust in the front side and the rotary shaft bearing 46 rotates so as to slide on the shaft 3 and the front thrust bearing 60, so that friction heat is created between the rotary shaft bearing 46 and the shaft 3 and between the rotary shaft bearing 46 and the front thrust bearing 60. There is however no bad influence attended by the friction heat, because the friction heat is cooled by the liquid reserved in the casing.

Figure 13:
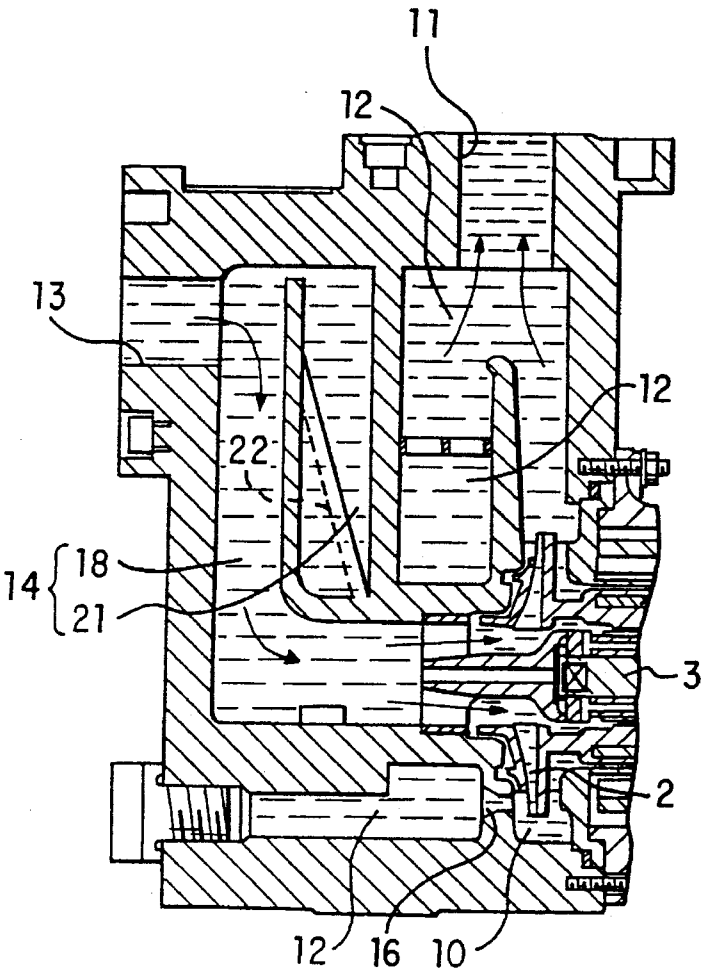
FIG. 13 is a longitudinal section showing the operation of the self-priming chemical pump according to the present invention.
Figure 15:
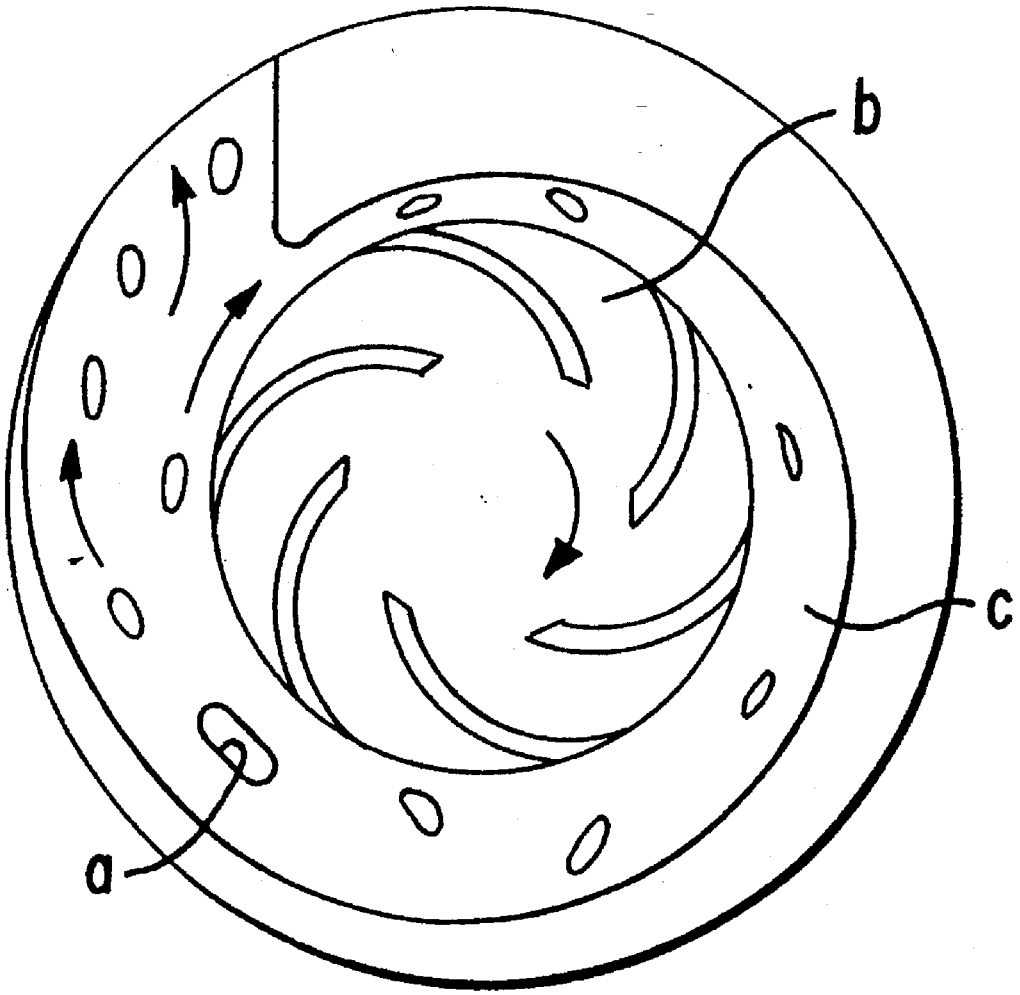
FIG. 15 PRIOR ART
FIG. 15 is a section showing a conventional self-priming chemical pump.

As described above, when the liquid in the suction passage 18 of the suction chamber 14 and in the vortex chamber 10 is discharged to the discharge side of the vortex chamber 10, liquid reserved in the self-priming chamber 12 is directly injected into the impeller 2 through the circulation hole 16 which is inside the outer diameter of the impeller 2. Accordingly, the liquid in the self-priming chamber 12 as well as the liquid in the suction passage 18 and in the vortex chamber 10 are discharged rapidly to the discharge side of the vortex chamber 10 by the centrifugal force of the impeller 2 so as to be moved to the self-priming chamber 12. Furthermore, liquid in the self-priming liquid remaining portion 21 enters the suction passage 18 through the communication hole 19 and is discharged rapidly to the discharge side of the vortex chamber 10 so as to be moved to the self-priming chamber 12. Accordingly, pressure at the center portion of the impeller 2 becomes high negative pressure and, further, pressure in the suction passage 18 becomes negative pressure. Accordingly, the liquid in the suction piping is moved up, mixed with air and discharged to the self-priming chamber 12 from the vortex chamber 10. The air sucked together with the liquid through the suction passage 18 in this occasion is prevented from acting by the seal wall 15 of the vortex chamber 10. That is, the air is moved with the liquid to the self-priming chamber 12 without circulating in the vortex chamber 10. The mixture of air and liquid is rotated by the curved layer 30, so that the air is selectively discharged through the discharge opening 11 by the centrifugal force thereof because of difference in specific gravity. Further, the mixture of air and liquid collides with the air separation plate 17, so that the separation of air from liquid is accelerated. The liquid passes through the pores 17*a* of the air separation plate 17 to the lower portion of the self-priming chamber 12 and is directly injected into the impeller 2 through the circulation hole 16 again, so that the liquid circulates (see FIGS. 8 and 9). Because the liquid reserved in the suction chamber 14 and in the self-priming chamber 12 circulates between the vortex chamber 10 and the self-priming chamber 12 so that the negative pressure at the center portion of the impeller 2 is kept still high, air in the suction piping and in the suction passage 18 of the suction chamber 14 is first discharged almost thoroughly (see FIG. 10) and then liquid moves from the communication hole 19 into the self-priming liquid remaining portion 21 (see FIG. 11) whereas air in the self-priming liquid remaining portion 21 is discharged from the air vent hole 20 to the discharge opening 11 mainly through the shortest passage 22 of the suction passage 18, the vortex chamber 10 and the self-priming chamber 12 to thereby complete self-priming (see FIG. 12). After the completion of self-priming, a steady-state operation is carried out (FIG. 13). Incidentally, if the volume of the self-priming chamber 12 is set to be equal to the volume of the suction chamber 14, the whole quantity of liquid in the suction chamber 14 is moved to the self-priming chamber 12 by the rotation of the impeller 2 so that the liquid surface in the suction piping is moved up correspondingly, and then liquid twice as much as liquid before the movement circulates in the self-priming chamber 12 and the vortex chamber 10 after the movement. Accordingly, the quantity of sucked liquid is large, so that the self-priming operation is completed speedily. On the other hand, when the self-priming chemical pump is not in a state shown in FIG. 7, that is, when no liquid remains in the pump for some reason, the pump runs idle. In the case where the pump runs idle, the rotary shaft bearing 46 does not come into contact with the front and rear thrust bearings 60 and 61 because there is no liquid as cooling water, that is, because there is no thrust given to the front side as described above. Accordingly, friction heat is created only in the slide portion between the shaft 3 and the rotary shaft bearing 46, so that the temperature of the slide portion becomes high. The high-temperature friction heat created in the slide portion tries to conduct to the impeller 2 and the magnet can 49 mainly through the rotary shaft bearing 46 and the heat insulating member 47 but the conduction of the friction heat is almost cut off on the basis of the principle of a vacuum bottle mainly constituted by the heat conduction blocking grooves 64 of the rotary shaft bearing 46 and the heat conduction blocking grooves 47*a* of the heat insulating member 47. That is, because not only the state of the high-temperature friction heat is changed from conduction to convection when the friction heat reaches the surfaces of the heat conduction blocking grooves 64 and 47*a* but also air is moved by the rotation of the heat conduction blocking grooves 64 and 47*a*, the high-temperature friction heat at the surfaces of the heat conduction blocking grooves 64 and 47*a* is cooled by air. In addition, because the heat insulating member 47 is provided separately, a material high in heat insulating effect can be selected freely as the material for the heat insulating member 47, so that the friction heat is cut off efficiently.

Further, the high-temperature friction heat created in the slide portion tries to conduct mainly to the shaft 3, the front side fixed shaft bearing 45 and the outer wall of the self-priming chamber 12 but the conduction of the friction heat is almost cut off on the basis of the same principle as described above, mainly constituted by the heat conduction blocking grooves of the shaft 3, the heat conduction blocking grooves 45*a* of the front side fixed shaft bearing 45, the liquid conducting passage 45*b* thereof, the heat radiation hole 45*c* thereof and the heat conduction blocking grooves of the cushioning member 62.

Further, the high-temperature friction heat created in the slide portion tries to conduct to the rear casing 41 from the shaft 3 through the rear side fixed shaft bearing 44 but the conduction of the friction heat is almost cut off on the basis of the same principle as described above, mainly constituted by the heat conduction blocking grooves formed in the shaft 3 and the heat conduction blocking grooves 44*a* formed in the rear side fixed shaft bearing 44.

Further, when the impeller 2 is stopped, liquid in the suction piping falls down so as to flow backward. As a result, the pressure in the suction chamber 14 becomes negative, so that the liquid surface in the discharge side passage of the vortex chamber 10 is moved down so as to be lower than the level of the suction side passage of the vortex chamber 10. In this occasion, air from the discharge opening 11 is made to escape from the suction opening 13 linearly via the vortex chamber 10 and the siphon-cut shortest passage 22 so as to be siphon-cut (see FIG. 14). Accordingly, liquid is not made to escape any more, so that a state shown in FIG. 7 is obtained.

Incidentally, the rotary shaft bearing 46 collides with the front and rear thrust bearings 60 and 61 at the time of the shifting of the operation from ordinary running to idle running or at the time of the shifting of the operation from idle running to ordinary running but the shock created by the collision is absorbed by the cushioning members 62 and 63.

As described above in detail, in the self-priming chemical pump according to the present invention, when the impeller is rotated, liquid reserved in the self-priming chamber is directly injected into the impeller from the circulation hole located in the inside of the outer circumference of the impeller so that the liquid remaining in the self-priming chamber together with liquid remaining in the suction chamber is discharged rapidly to the discharge side of the vortex chamber by the centrifugal force of the impeller so as to be moved to the self-priming chamber. Accordingly, the negative pressure at the center portion of the impeller becomes high, so that liquid in the suction piping is moved up whereas air is mixed with the liquid given from the suction chamber and the circulation hole and discharged to the self-priming chamber from the vortex chamber. The air sucked together with the liquid from the suction chamber in this occasion is prevented from circulating in the vortex chamber by the seal wall of the vortex chamber. Accordingly, the air is moved with the liquid to the self-priming chamber. Then, the air light in specific gravity is discharged from the discharge opening whereas the liquid is reserved in the self-priming chamber so that the liquid is directly injected into the impeller from the circulation hole again so as to circulate. After the air is discharged thoroughly from the suction piping, the suction chamber, the vortex chamber and the self-priming chamber, a steady-state operation is carried out. Accordingly, the self-priming time is shortened by the provision of the high negative pressure, so that measures can be taken rapidly against high-temperature liquid or liquid containing bubbles.

Further, when liquid containing air is discharged from the vortex chamber to the self-priming chamber by the impeller so as to circulate, the liquid collides with the air separation plate. As a result, air light in specific gravity is moved up so as to escape from the discharge opening. Accordingly, air can be escaped more rapidly, so that the aforementioned effect is accelerated.

Further, when the impeller is stopped and the liquid in the suction piping falls down so as to flow backward so that the liquid surface in the discharge side passage of the vortex chamber is moved down so as to be lower than the level of the suction side passage of the vortex chamber, air escapes from the suction opening linearly through the siphon-cut shortest passage. Accordingly, a larger amount of liquid than necessary is prevented from escaping. That is, a large quantity of self-priming liquid can remain, so that the aforementioned effect is made more remarkable.

Further, when the volume of the self-priming chamber is equal to the volume of the suction chamber, the whole quantity of liquid in the suction chamber is moved to the self-priming chamber by the rotation of the impeller so that the liquid surface in the suction piping is moved up correspondingly and liquid twice as much as liquid before the movement circulates in the self-priming chamber and the vortex chamber. Accordingly, the quantity of sucked liquid is large, so that the self-priming operation is completed speedily. Accordingly, the aforementioned effect is made more remarkable.

Further, when the pump portion is constituted by a magnet pump, liquid leaking is avoided because there is no shaft seal portion. Further, even in the case where the pump runs idle, the rotary shaft bearing does not slide against the thrust bearings because there is no thrust created in the impeller. That is, in this case, friction heat is created only between the impeller and the rotary shaft bearing. The heat conduction blocking grooves formed in the rotary shaft bearing constitute a double structure like the structure of a vacuum bottle, so that the conduction of the friction heat is almost prevented by an air layer of low heat conductivity in the heat conduction blocking grooves. Further, because the rotary shaft bearing can rotate, air is stirred by the heat conduction blocking grooves. As a result, air moves so that friction heat scatters. Accordingly, heat is hardly conducted to the impeller, or the like. In addition, heat is hardly conducted by the heat insulating characteristic of the heat insulating member per se. Accordingly, in addition to the aforementioned effect, the damaging of the pump caused by heat is avoided so that serious accidents caused by liquid leakage can be prevented even in the case where the self-priming liquid is made empty for some reason so that the pump runs idle.

Further, not only friction heat between the rotary shaft bearing and the shaft scatters from the heat radiation hole of the front side fixed shaft bearing and the liquid conducting passage thereof but also the friction heat scatters from other surfaces of the front side fixed shaft bearing because the distance from the friction heat creating portion to the casing is large. Accordingly, the heat is hardly conducted to the casing or the like. Accordingly, the aforementioned effect is made more remarkable.

Further, though the rotary shaft bearing collides with the thrust bearings at the time of the shifting of the operation from ordinary running to idle running or at the time of the shafting of the operation from idle running to ordinary running, the shock created by the collision is absorbed by the cushioning members. Accordingly, in addition to the aforementioned effect, damaging, cracking, etc. of the pump caused by the shock can be avoided.

Further, when the heat conduction blocking grooves are provided in the heat insulating member, cushioning members and front side and rear side fixed shaft bearings, not only the friction heat is hardly conducted in accordance with the principle of a vacuum bottle but also air is moved by the air stirring function to make the friction heat scatter. Accordingly, the aforementioned effect is made more remarkable.

What is claimed is:

1. A self-priming chemical pump comprising:

a pump portion including at least an impeller and a shaft supporting said impeller;

a self-priming mechanism portion including a self-priming chamber which is provided in the discharge side of a vortex chamber of said impeller so as to communicate with a discharge opening, and a suction chamber which is provided in the suction side of said vortex chamber of said impeller so as to communicate with a suction opening;

a seal wall which is provided in the vicinity of the discharge side of said vortex chamber to form a slight gap along the outer circumference of said impeller; and a circulation hole which is provided in said self-priming chamber so as to be located inside the outer circumference of said impeller, wherein said suction chamber comprises an L-shaped suction passage for making said suction opening communicate with the suction side of said vortex chamber, and a self-priming liquid remaining portion having pores communicating with said suction passage; and wherein said self-priming chemical pump further comprises a siphon-cut shortest passage which is provided in said suction passage, and the volume of said self-priming chamber is substantially equal to the volume of said suction chamber.

2. A self-priming chemical pump according to claim 1, further comprising an air separation plate which is provided in said self-priming chamber.

3. A self-priming chemical pump according to claim 1, wherein said pump portion is constituted by a magnet pump which includes: a casing surrounded by a rear casing and an outer wall of said self-priming chamber; said impeller rotatably mounted on a shaft put in said casing and fixed to said casing through fixed shaft bearings; a rotary shaft bearing having heat conduction blocking grooves and being provided between said shaft and said impeller; a heat insulating member fixed on the whole circumference of said rotary shaft bearing and provided between said shaft and said impeller; and thrust bearings provided on said shaft located at axially opposite sides of said rotary shaft bearing so that said thrust bearings are disposed at a predetermined distance from said rotary shaft bearing at the time of idle operation of said impeller.

4. A self-priming chemical pump according to claim 3, wherein said self-priming chemical pump further comprises a front side fixed shaft bearing which is provided separately and fitted into the outer wall of said self-priming chamber of said casing; and wherein said front side fixed shaft bearing has a liquid conducting passage and a heat radiation hole which are formed between said casing and said shaft.

5. A self-priming chemical pump according to claim 3, wherein cushioning members are provided respectively between said two thrust bearings and front side and rear side fixed shaft bearings which are disposed at opposite ends of said shaft respectively.

6. A self-priming chemical pump according to claim 5, wherein heat conduction blocking grooves are provided in said heat insulating member, said cushioning members and said front side and rear side fixed shaft bearings, respectively.

* * * * *